US008118018B1

(12) United States Patent
Sherment

(10) Patent No.: US 8,118,018 B1
(45) Date of Patent: Feb. 21, 2012

(54) HORIZONTAL CONCRETE SAW ATTACHMENT

(75) Inventor: John T. Sherment, Jenks, OK (US)

(73) Assignee: The John T. Sherment Trust, Jenks, OK (US)

( * ) Notice: Subject to any disclaimer, the term of this patent is extended or adjusted under 35 U.S.C. 154(b) by 1013 days.

(21) Appl. No.: 12/048,702

(22) Filed: Mar. 14, 2008

(51) Int. Cl.
*B28D 1/04* (2006.01)

(52) U.S. Cl. ..... 125/13.01; 125/13.03; 30/388; 451/352; 451/450

(58) Field of Classification Search ..... 125/12, 125/13.01, 13.03, 14; 451/352, 449, 450; 30/388, 389, 122; 83/473; 299/39.9
See application file for complete search history.

(56) References Cited

U.S. PATENT DOCUMENTS

| | | | | |
|---|---|---|---|---|
| 3,896,783 | A | 7/1975 | Manning | |
| 4,357,120 | A | 11/1982 | MacDonald | |
| 4,570,609 | A | 2/1986 | Hogue | |
| 4,821,415 | A * | 4/1989 | Kress | 30/122 |
| 5,044,696 | A | 9/1991 | Blackhurst | |
| 5,077,896 | A * | 1/1992 | Rivera | 30/122 |
| 5,664,553 | A * | 9/1997 | Chiuminatta et al. | 125/13.01 |
| 5,676,125 | A | 10/1997 | Kelly et al. | |
| 6,158,817 | A | 12/2000 | Bertrand | |
| 6,592,289 | B1 * | 7/2003 | Weander | 404/74 |
| 6,868,847 | B2 * | 3/2005 | Ainedter et al. | 125/12 |
| 7,056,188 | B1 * | 6/2006 | Triplett et al. | 451/5 |
| 7,232,361 | B1 * | 6/2007 | Triplett et al. | 451/5 |
| 2009/0183722 | A1 * | 7/2009 | Marques et al. | 125/13.01 |
| 2011/0225908 | A1 * | 9/2011 | Nadler | 52/223.6 |

* cited by examiner

*Primary Examiner* — Eileen P. Morgan
(74) *Attorney, Agent, or Firm* — Molly D. McKay

(57) ABSTRACT

An attachment for an existing commercial concrete saw to convert the vertically cutting saw to a horizontally cutting saw. The saw's vertically oriented saw blade and associated horizontal shaft are first removed and the attachment is installed on the saw. The attachment has a gear box with pulley for receiving power from a pulley on the saw via a drive belt that extends around both pulleys. The gear box has a drive shaft extending vertically downward out of the gear box. Either a horizontal saw blade or cup brush can be removably attached to the drive shaft so that the saw can be used for making horizontal cuts in concrete or alternately the cup brush can be used to remove striping off the surface of a road. The gear box and the horizontal saw blade or cup brush are water cooled and lubricated.

19 Claims, 4 Drawing Sheets

HORIZONTAL CONCRETE SAW ATTACHMENT

BACKGROUND OF THE INVENTION

1. Field of the Invention

The present invention is an attachment for an existing commercial concrete saw to convert the vertically cutting saw to a horizontally cutting saw. To install this attachment, the existing vertically oriented saw blade and horizontal shaft are removed and the attachment is installed on the saw. The attachment has a gear box with a gear box pulley for receiving power from a power pulley provided on the saw via a drive belt that extends around both pulleys. The gear box has a drive shaft extending vertically downward out of the gear box. A horizontal saw blade can be removably attached to the drive shaft so that the saw can be used for making horizontal cuts in concrete. Alternately a cup brush can be attached to the drive shaft so that the saw can be used to remove striping off the surface of a road. Both the gear box and the saw blade or cup brush are water cooled and lubricated.

2. Description of the Related Art

Large commercial concrete saws are available for making vertical cuts in concrete when doing large jobs such as road repair. However, when it is necessary to make horizontal cuts in concrete, such as when a curb must be cut, the large commercial concrete saw cannot be used since it is only able to cut vertically. Instead, a hand held concrete saw is normally used to make the horizontal cuts. Cutting with a hand held concrete saw is dangerous, hard, and time consuming. Thus it would be desirable to be able to convert a large commercial concrete saw from vertically cutting to horizontally cutting.

The present invention addresses the need to be able to convert a commercial concrete saw to a horizontal cutting tool by providing an attachment for the commercial saw that converts the saw from vertically cutting to horizontally cutting. Also, by replacing the cutting blade with a cup brush, the attachment can alternately be converted to a tool for cutting striping off of a road surface.

SUMMARY OF THE INVENTION

The present invention is an attachment for an existing commercial concrete saw to convert the vertically cutting saw to a horizontally cutting saw that can be used to cut vertically oriented curbs or other vertically oriented concrete structures. To install this attachment, the existing vertically oriented saw blade and horizontal shaft are first removed from the saw, and then the frame of the attachment is bolted onto the frame of the saw. The frame of the attachment has adjustment bolts for making slight adjustments in the vertical and lateral positioning of the attachment relative to the saw.

The frame of the attachment supports a gear box. A gear box pulley for supplying power to the gear box from the saw extends from the side of the gear box. A drive belt extends around both the gear box pulley that powers the gear box and around a power pulley provided on the saw that was the original power source for rotating the now removed horizontal shaft and vertical saw blade. For safety purposes, a removable shroud covers portions of the attachment to prevent injury to the operator from contact with moving parts when the saw is being operated.

The gear box has a drive shaft extending vertically downward out of the gear box. A horizontal saw blade can be removably attached to the drive shaft via blade bolts that extend through the blade and engage threaded openings provided on the drive shaft so that the saw can be used for making horizontal cuts in concrete. Water is supplied via water hoses from the saw to both the gear box and to the horizontal saw blade as a means of cooling and lubricating these items. A water nozzle is provided on the gear box to supply water to the gear box, and a water spray bar extends above and across the entire diameter of the saw blade to evenly distribute water to the top surface of the blade. The saw blade is provided with blade openings that extend through the blade so that water can flow through these blade openings and cool and lubricate the bottom surface of the blade, thereby preventing the blade from warping. For safety purposes, a blade guard is secured to the frame of the attachment to protect the operator from being injured by the blade. The spray bar attaches to the blade guard and remains on the attachment even when the horizontal blade is removed.

Alternately a cup brush with wire bristles on its bottom surface can be attached to the drive shaft instead of a horizontal blade so that the saw can be used to remove striping off the surface of a road. The cup brush attaches to the drive shaft with brush bolts that engage the threaded openings in the drive shaft. As with the horizontal saw blade, the cup brush is provided with brush openings that extend through the cup brush so that water from the spray bar can flow through these brush openings and cool and lubricate the bottom surface and bristles of the cup brush and thereby prevent the cup brush from warping.

DETAILED DESCRIPTION OF THE PREFERRED EMBODIMENT

Figure 1:
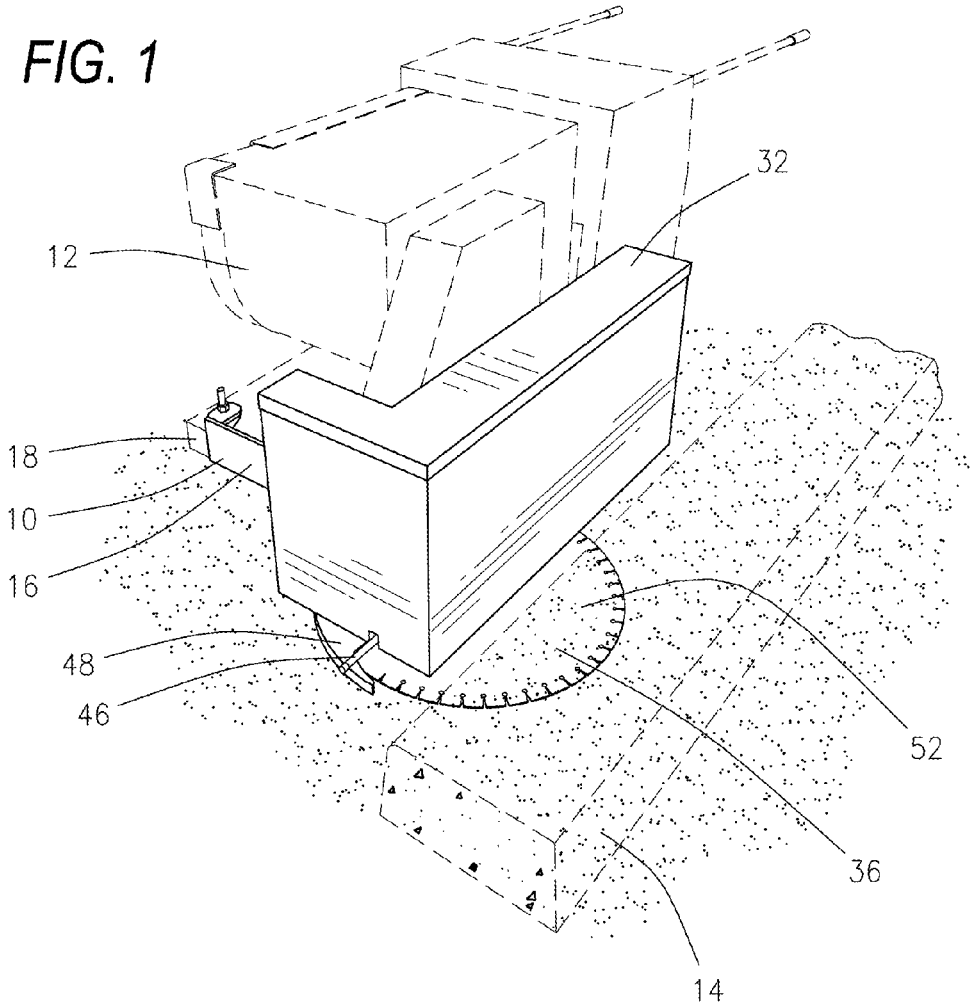
FIG. 1 is left side perspective view of a horizontal concrete saw attachment of the present invention taken from the front of the attachment shown secured to a commercial concrete saw which is drawn in outline illustrating usage of the attachment to cut a curb which is also drawn in outline.

Referring now to the drawings and initially to FIGS. 1-5, there is illustrated an attachment 10 for an existing commercial concrete saw 12 to convert the saw 12 from vertically cutting to horizontally cutting. With this attachment 10, the saw 12 can be used to cut vertically oriented curbs 14 or other vertically oriented concrete structures. To use the attachment 10, the existing vertically oriented saw blade (not illustrated) and horizontal shaft (not illustrated) are first removed from the saw 12, and then a frame 16 of the attachment 10 is bolted onto the frame 18 of the saw 12. The frame 16 of the attachment 10 has adjustment bolts 20 for making slight adjustments in the vertical and lateral position of the attachment 10 relative to the saw 12.

Figure 3:
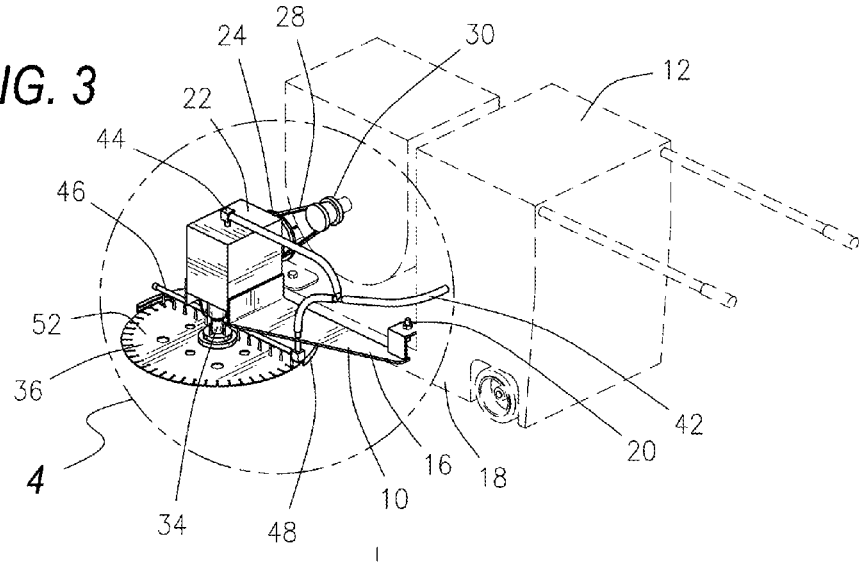
FIG. 3 is left side perspective view of the attachment of FIG. 1 taken from the rear of the attachment.
Figure 4:
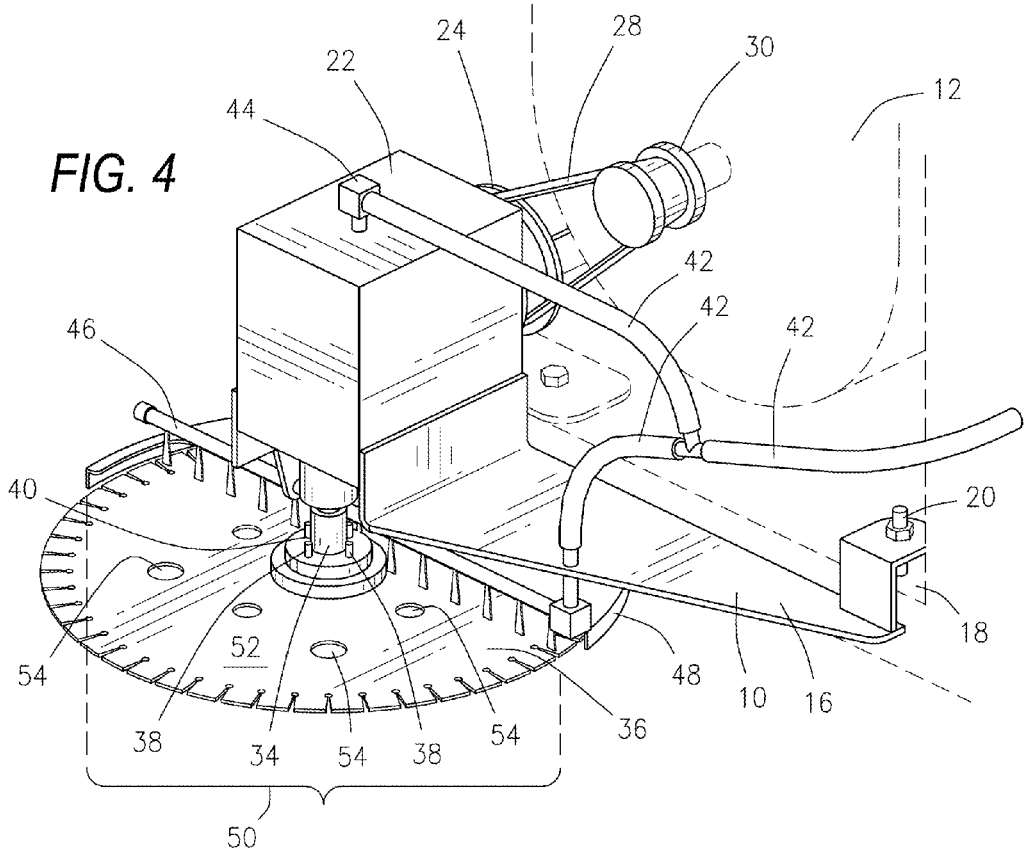
FIG. 4 is an enlarge view of the area contained within circle 4 of FIG. 3.
Figure 5:
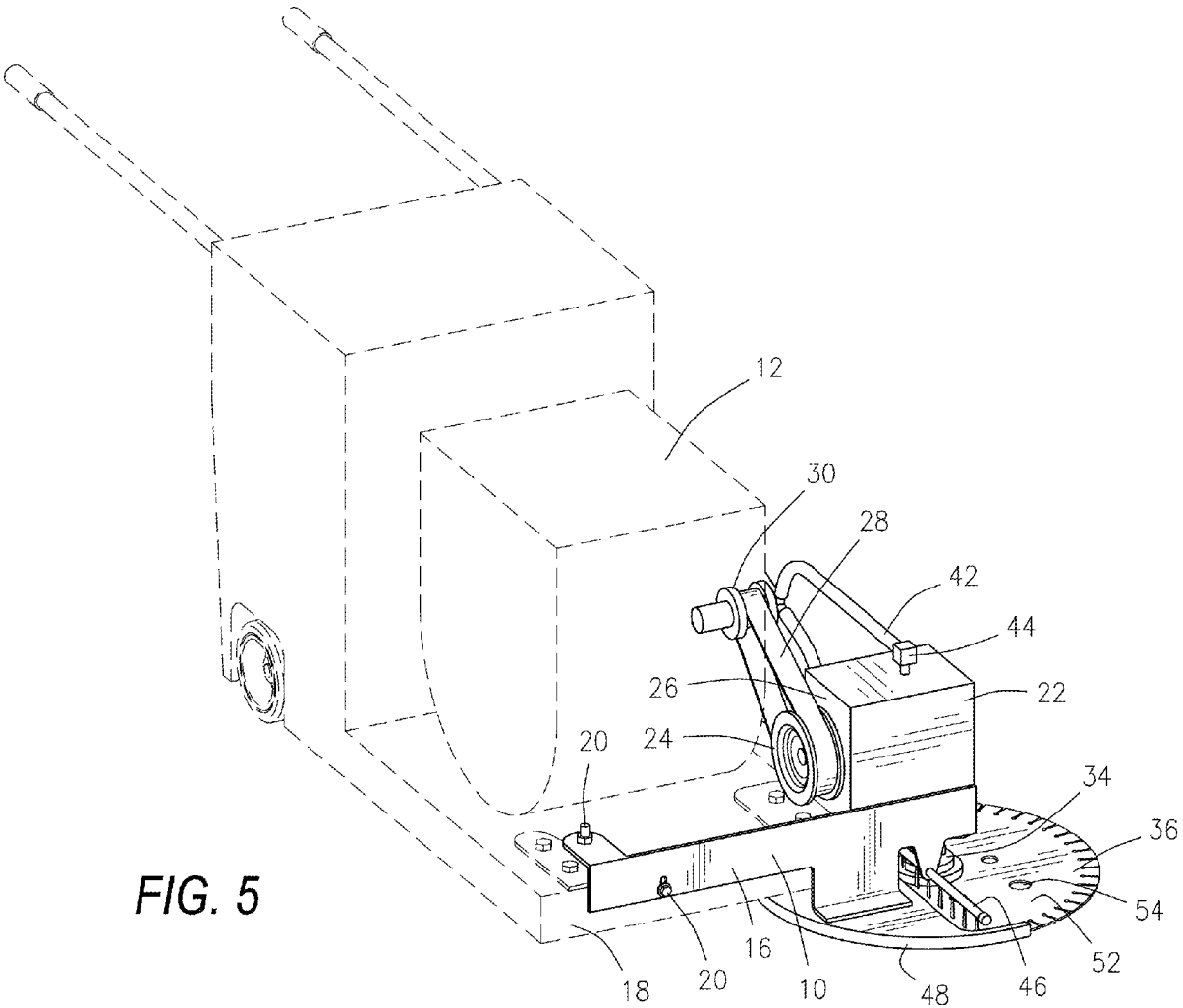
FIG. 5 is right side perspective view of the attachment of FIG. 1 taken from the front of the attachment.

As illustrated in FIGS. 3-5, the frame 16 of the attachment 10 supports a gear box 22. A gear box pulley 24 for supplying power to the gear box 22 from the saw 12 extends from the side 26 of the gear box 22. A drive belt 28 extends around both the gear box pulley 24 that powers the gear box 22 and around a power pulley 30 provided on the saw 12 that was the original power source for rotating the now removed horizontal shaft and vertical saw blade. As illustrated in FIG. 1, for safety purposes a removable shroud 32 covers portions of the attachment 10 to prevent injury to the operator by contact with moving parts when the saw 12 is being operated. This shroud 32 has been removed in FIGS. 3-5 to reveal the underlying structures.

Figure 2:
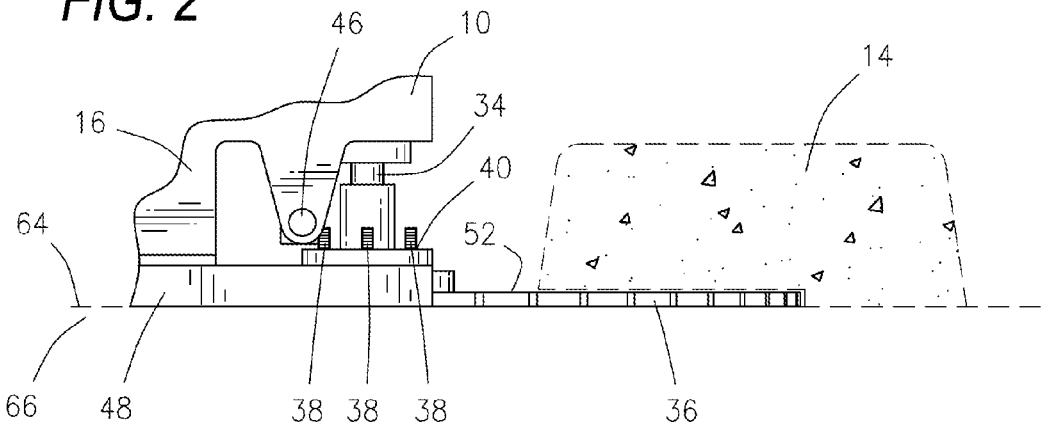
FIG. 2 is a front view of the attachment and curb of FIG. 1.

As illustrated in FIGS. 2, 3 and 4, the gear box 22 has a drive shaft 34 extending vertically downward out of the gear box 22 that can provided rotary power to anything that is attached to it.

Figure 6:
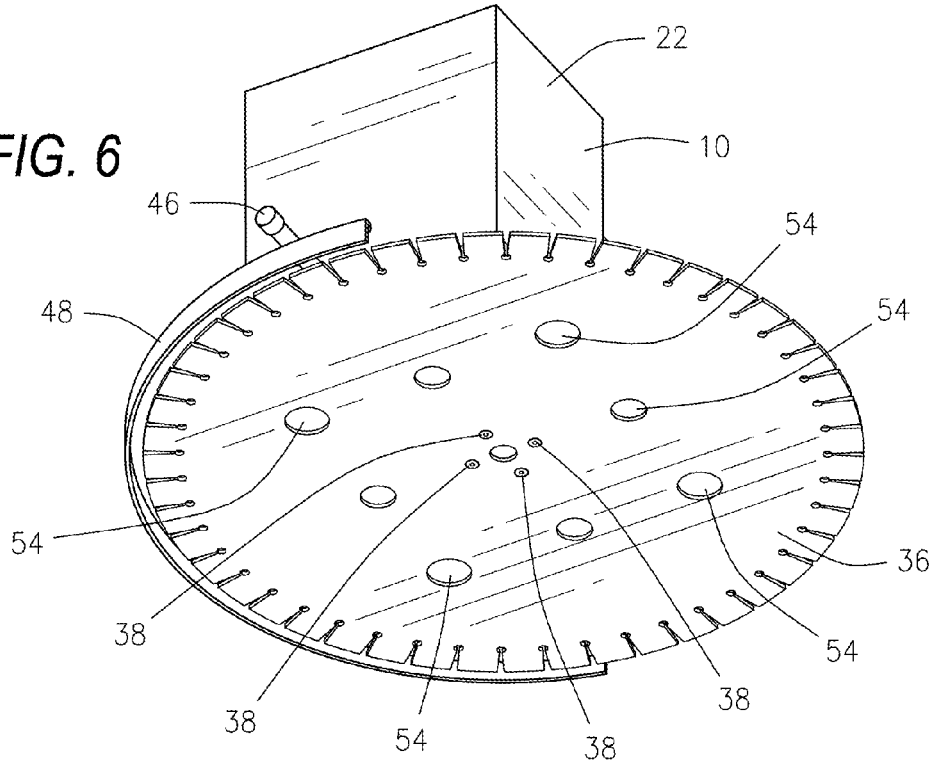
FIG. 6 is bottom perspective view of a horizontal saw blade shown attached to the drive shaft of the gear box with all the rest of the attachment removed for clarity.

Also referring to FIG. 6, a horizontal saw blade 36 can be removably attached to the drive shaft 34 via countersunk blade bolts 38 that extend through the blade 36 and engage threaded openings 40 provided on the drive shaft 34 so that the saw 12 can be used for making horizontal cuts in concrete.

Again referring to FIGS. 3-5, water is supplied via water hoses 42 from the saw 12 to both the gear box 22 and to the horizontal saw blade 36 as a means of cooling and lubricating these items. A water nozzle 44 is provided on the gear box 22 to supply water to the gear box 22, and a water spray bar 46. The water spray bar 46 is attached to a blade guard 48 and extends above and across the entire diameter 50 of the blade guard 48 so that it delivers water evenly on a top surface 52 of the horizontal saw blade 36. The blade guard 48 is attached to the attachment frame 16 and located immediately above the blade 36 to prevent the operator from being injured by accidental contact with the blade 36. The horizontal saw blade 36 is provided with blade openings 54 that extend through the blade 36 so that water that is applied to the top surface 52 can flow through these blade openings 54 and thus cool and lubricate the bottom surface 56 of the blade 36 also, thereby preventing the blade 36 from warping. For safety purposes, the blade guard 48 is secured to the frame 16 of the attachment 10 and serves to protect the operator from being injured by the blade 36 when the saw 12 is in operation. The water spray bar 46 and the blade guard 48 remain on the attachment 10 even when the horizontal blade 36 is removed.

Figure 7:
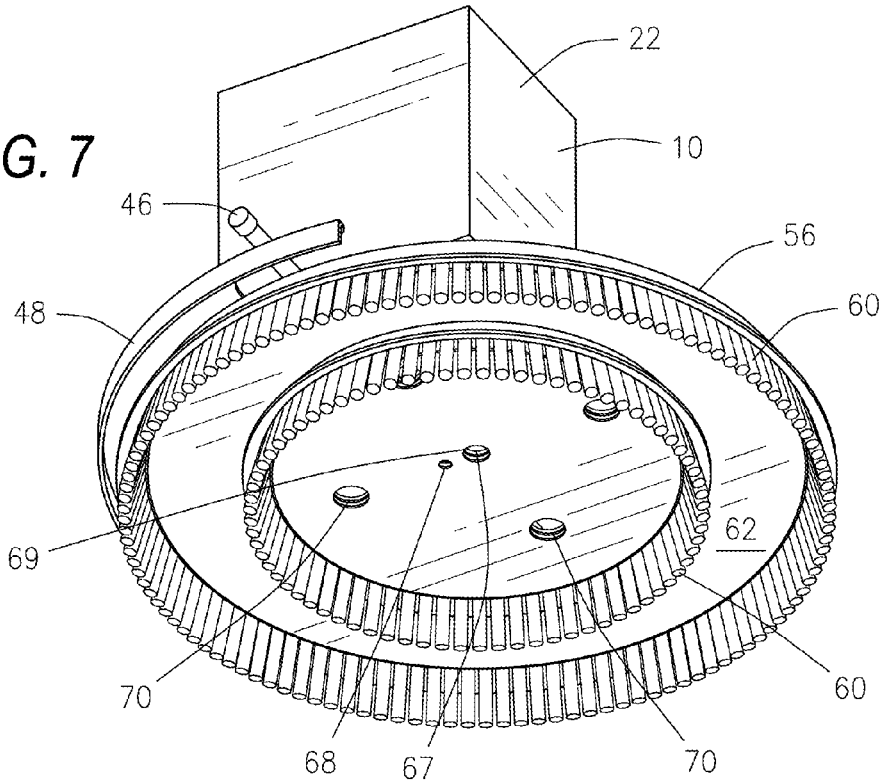
FIG. 7 is a bottom perspective view of a cup brush shown attached to the drive shaft of the gear box with all the rest of the attachment removed for clarity.

Referring to FIG. 7, alternately a cup brush 56 that has wire bristles 60 on its bottom surface 62 can be attached to the drive shaft 34 instead of a horizontal blade 36 so that the saw 12 can be used to remove striping off a surface 64 of a road 66. As illustrated in FIG. 7, the cup brush 56 removably attaches to the drive shaft 34 via a coarse threaded, right hand bolt 67 that inserts via the bottom surface 62 of the cup brush 56 through a central opening 69 provided in the cup brush 56 and engages a female threaded opening (not illustrated) centrally provided in the drive shaft 34. Also, as illustrated in FIG. 7, the cup brush 56 is provided with a pin opening 68 into which a shear pin (not illustrated) inserts so that the shear pin engages both the cup brush 56 and the drive shaft 34 for the purpose of providing slippage in the event that the cup brush 56 is suddenly stopped from turning while the draft shaft 34 is turning. As with the horizontal saw blade 36, the cup brush 56 is provided with brush openings 70 that extend through the cup brush 56 so that water from the water spray bar 46 can flow through these brush openings 70 and cool and lubricate the bottom surface 62 and bristles 60 of the cup brush 56 and thereby prevent the cup brush 56 from warping.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A horizontal concrete saw attachment for use with an existing commercial concrete saw to convert the vertically cutting saw to a horizontally cutting saw comprising:

an attachment frame attachable to a saw frame of an existing concrete saw after removing the saw's vertically cutting blade and associated horizontal shaft, a gear box mounted on the frame of the attachment, means for transmitting rotary power from the concrete saw to the gear box, a drive shaft vertically extending from the gear box for transmitting rotary power from the gear box, a horizontally oriented tool attached to the drive shaft, and means for cooling and lubricating the gear box and horizontally oriented tool.

2. A horizontal concrete saw attachment according to claim 1 wherein said attachment frame is adjustably attachable to the saw frame via adjustment bolts.

3. A horizontal concrete saw attachment according to claim 1 wherein the means for transmitting rotary power from the concrete saw to the gear box further comprises:

a gear box pulley attached to said gear box and a drive belt extending around the gear box pulley and around a power pulley provided on the cement saw.

4. A horizontal concrete saw attachment according to claim 1 wherein the horizontally oriented tool is a saw blade.

5. A horizontal concrete saw attachment according to claim 1 wherein the horizontally oriented tool is a cup brush.

6. A horizontal concrete saw attachment according to claim 1 wherein the means for cooling and lubricating the gear box and horizontally oriented tool further comprise:

water hoses supplying water from the concrete saw to the gear box and to the horizontally oriented tool.

7. A horizontal concrete saw attachment according to claim 6 wherein the means for cooling and lubricating the gear box further comprises:

a water nozzle attached to one of said water hoses to provide water to the gear box.

8. A horizontal concrete saw attachment according to claim 6 wherein the means for cooling and lubricating the horizontally oriented tool further comprises:

a water spray bar attached to one of said hoses so said water spray bar extends above and supplies water across the horizontally oriented tool.

9. A horizontal concrete saw attachment according to claim 8 wherein the horizontally oriented tool is provided with openings that extend through the tool to allow water to flow through the tool to reach the bottom surface of the tool.

10. A horizontal concrete saw according to claim 1 further comprising:

a blade guard provided attached to the attachment frame and located immediately above the horizontally oriented tool.

11. A horizontal concrete saw according to claim 1 further comprising:

at least one protective shroud removably secured over portions of the attachment to protect the operator from contact with moving parts on the attachment.

12. A horizontal concrete saw attachment according to claim 1 wherein the means for transmitting rotary power from the concrete saw to the gear box further comprises:

a gear box pulley attached to said gear box and a drive belt extending around the gear box pulley and around a power pulley provided on the cement saw.

13. A horizontal concrete saw attachment according to claim 12 wherein the means for cooling and lubricating the gear box and horizontally oriented tool further comprise:

water hoses supplying water from the concrete saw to the gear box and to the horizontally oriented tool.

14. A horizontal concrete saw attachment according to claim 13 wherein the means for cooling and lubricating the gear box further comprises:

a water nozzle attached to one of said water hoses to provide water to the gear box.

15. A horizontal concrete saw attachment according to claim 14 wherein the means for cooling and lubricating the horizontally oriented tool further comprises:

a water spray bar attached to one of said hoses so said water spray bar extends above and supplies water across the horizontally oriented tool.

16. A horizontal concrete saw attachment according to claim 15 wherein the horizontally oriented tool has openings through the tool to allow water to flow through the tool to reach the bottom surface of the tool.

17. A horizontal concrete saw according to claim 16 further comprising:

a blade guard provided attached to the attachment frame and located immediately above the horizontally oriented tool, and at least one protective shroud removably secured over portions of the attachment to protect the operator from contact with moving parts on the attachment.

18. A horizontal concrete saw attachment according to claim 17 wherein said attachment frame is adjustably attachable to the saw frame via adjustment bolts.

19. A horizontal concrete saw attachment according to claim 16 wherein the horizontally oriented tool is selected from the following list:

a saw blade and a cup brush.

* * * * *